US008310500B2

(12) United States Patent
Wang

(10) Patent No.: US 8,310,500 B2
(45) Date of Patent: Nov. 13, 2012

(54) STORAGE METHOD FOR GAMMA VALUE LOOK-UP TABLE

(75) Inventor: Jian-Feng Wang, Shenzhen (CN)

(73) Assignee: Chimei Innolux Corporation, Miaoli County (TW)

( * ) Notice: Subject to any disclaimer, the term of this patent is extended or adjusted under 35 U.S.C. 154(b) by 881 days.

(21) Appl. No.: 12/383,336

(22) Filed: Mar. 23, 2009

(65) Prior Publication Data

US 2009/0237414 A1 Sep. 24, 2009

(30) Foreign Application Priority Data

Mar. 21, 2008 (TW) ..... 97110106 A

(51) Int. Cl.
*G09G 3/36* (2006.01)
*G09G 5/02* (2006.01)
*G09G 5/10* (2006.01)

(52) U.S. Cl. ..... 345/590; 345/89; 345/589; 345/690

(58) Field of Classification Search ..... 345/89, 345/589, 590, 596, 599, 690
See application file for complete search history.

(56) References Cited

U.S. PATENT DOCUMENTS 7,317,462 B2 1/2008 Lu et al.
7,365,723 B2 4/2008 Lee et al.
7,990,401 B2 * 8/2011 Li et al. ..... 345/690

* cited by examiner

*Primary Examiner* — Hau Nguyen
(74) *Attorney, Agent, or Firm* — Bacon & Thomas, PLLC

(57) ABSTRACT

A storage method for a gamma value look-up table comprises storing gamma values corresponding to grays exceeding or equaling a 33rd gray in the gamma value look-up table, and calculating gamma values corresponding to a 1st gray to a 32nd gray by a formula.

6 Claims, 2 Drawing Sheets

| address \ byte | bit7 | bit6 | bit5 | bit4 | bit3 | bit2 | bit1 | bit0 |
|---|---|---|---|---|---|---|---|---|
| 279 | bit9(256) | bit8(256) | bit9(255) | bit8(255) | bit9(254) | bit8(254) | bit9(253) | bit8(253) |
| 278 | bit7(256) | bit6(256) | bit5(256) | bit4(256) | bit3(256) | bit2(256) | bit1(256) | bit0(256) |
| 277 | bit7(255) | bit6(255) | bit5(255) | bit4(255) | bit3(255) | bit2(255) | bit1(255) | bit0(255) |
| 276 | bit7(254) | bit6(254) | bit5(254) | bit4(254) | bit3(254) | bit2(254) | bit1(254) | bit0(254) |
| 275 | bit7(253) | bit6(253) | bit5(253) | bit4(253) | bit3(253) | bit2(254) | bit1(253) | bit0(253) |
| ⋮ | ⋮ | ⋮ | ⋮ | ⋮ | ⋮ | ⋮ | ⋮ | ⋮ |
| 4 | bit9(36) | bit8(36) | bit9(35) | bit8(35) | bit9(34) | bit8(34) | bit9(33) | bit8(33) |
| 3 | bit7(36) | bit6(36) | bit5(36) | bit4(36) | bit3(36) | bit2(36) | bit1(36) | bit0(36) |
| 2 | bit7(35) | bit6(35) | bit5(35) | bit4(35) | bit3(35) | bit2(35) | bit1(35) | bit0(35) |
| 1 | bit7(34) | bit6(34) | bit5(34) | bit4(34) | bit3(34) | bit2(34) | bit1(34) | bit0(34) |
| 0 | bit7(33) | bit6(33) | bit5(33) | bit4(33) | bit3(33) | bit2(33) | bit1(33) | bit0(33) |

| address \ byte | bit7 | bit6 | bit5 | bit4 | bit3 | bit2 | bit1 | bit0 |
|---|---|---|---|---|---|---|---|---|
| 279 | bit9(256) | bit8(256) | bit9(255) | bit8(255) | bit9(254) | bit8(254) | bit9(253) | bit8(253) |
| 278 | bit7(256) | bit6(256) | bit5(256) | bit4(256) | bit3(256) | bit2(256) | bit1(256) | bit0(256) |
| 277 | bit7(255) | bit6(255) | bit5(255) | bit4(255) | bit3(255) | bit2(255) | bit1(255) | bit0(255) |
| 276 | bit7(254) | bit6(254) | bit5(254) | bit4(254) | bit3(254) | bit2(254) | bit1(254) | bit0(254) |
| 275 | bit7(253) | bit6(253) | bit5(253) | bit4(253) | bit3(253) | bit2(254) | bit1(253) | bit0(253) |
| ⋮ | ⋮ | ⋮ | ⋮ | ⋮ | ⋮ | ⋮ | ⋮ | ⋮ |
| 4 | bit9(36) | bit8(36) | bit9(35) | bit8(35) | bit9(34) | bit8(34) | bit9(33) | bit8(33) |
| 3 | bit7(36) | bit6(36) | bit5(36) | bit4(36) | bit3(36) | bit2(36) | bit1(36) | bit0(36) |
| 2 | bit7(35) | bit6(35) | bit5(35) | bit4(35) | bit3(35) | bit2(35) | bit1(35) | bit0(35) |
| 1 | bit7(34) | bit6(34) | bit5(34) | bit4(34) | bit3(34) | bit2(34) | bit1(34) | bit0(34) |
| 0 | bit7(33) | bit6(33) | bit5(33) | bit4(33) | bit3(33) | bit2(33) | bit1(33) | bit0(33) |

FIG. 1

| address \ byte | bit7 | bit6 | bit5 | bit4 | bit3 | bit2 | bit1 | bit0 |
|---|---|---|---|---|---|---|---|---|
| 319 | bit9(256) | bit8(256) | bit9(255) | bit8(255) | bit9(254) | bit8(254) | bit9(253) | bit8(253) |
| 318 | bit7(256) | bit6(256) | bit5(256) | bit4(256) | bit3(256) | bit2(256) | bit1(256) | bit0(256) |
| 317 | bit7(255) | bit6(255) | bit5(255) | bit4(255) | bit3(255) | bit2(255) | bit1(255) | bit0(255) |
| 316 | bit7(254) | bit6(254) | bit5(254) | bit4(254) | bit3(254) | bit2(254) | bit1(254) | bit0(254) |
| 315 | bit7(253) | bit6(253) | bit5(253) | bit4(253) | bit3(253) | bit2(254) | bit1(253) | bit0(253) |
| ⋮ | ⋮ | ⋮ | ⋮ | ⋮ | ⋮ | ⋮ | ⋮ | ⋮ |
| 4 | bit9(4) | bit8(4) | bit9(3) | bit8(3) | bit9(2) | bit8(2) | bit9(1) | bit8(1) |
| 3 | bit7(4) | bit6(4) | bit5(4) | bit4(4) | bit3(4) | bit2(4) | bit1(4) | bit0(4) |
| 2 | bit7(3) | bit6(3) | bit5(3) | bit4(3) | bit3(3) | bit2(3) | bit1(3) | bit0(3) |
| 1 | bit7(2) | bit6(2) | bit5(2) | bit4(2) | bit3(2) | bit2(2) | bit1(2) | bit0(2) |
| 0 | bit7(1) | bit6(1) | bit5(1) | bit4(1) | bit3(1) | bit2(1) | bit1(1) | bit0(1) |

FIG. 2
(RELATED ART)

STORAGE METHOD FOR GAMMA VALUE LOOK-UP TABLE

BACKGROUND

1. Technical Field

The present disclosure relates to look-up tables, and specifically to a storage method for gamma value look-up tables.

2. Description of Related Art

A liquid crystal display (LCD) provides portability, low power consumption, and low radiation, and finds wide use in various portable information devices such as notebooks, personal digital assistants (PDAs), video cameras and others.

Gamma correction technology is widely used to improve the display quality of LCDs. A typical gamma correction technology requires gamma value look-up tables.

FIG. 2 shows a commonly used gamma value look-up table. Each gamma value is stored in a 10 bit form. The lower 8 bits from bit0(1) to bit7(1) of a gamma value corresponding to a 1st gray are stored in bit0 to bit7 of a byte corresponding to an address which is 0. The higher 2 bits from bit8(1) to bit9(1) are respectively stored in bit0 to bit1 of a byte corresponding to an address which is 4.

The lower 8 bits from bit0(2) to bit7(2) of a gamma value corresponding to a 2nd gray are stored in bit0 to bit7 of a byte corresponding to an address which is 1. The higher 2 bits from bit8(2) to bit9(2) are respectively stored in a bit2 to bit3 of a byte corresponding to an address which is 4.

The lower 8 bits from bit0(3) to bit7(3) of a gamma value corresponding to a 3rd gray are stored in bit0 to bit7 of a byte corresponding to an address which is 2. The higher 2 bits from bit8 (3) to bit9 (3) are respectively stored in a bit4 to bit5 of a byte corresponding to an address which is 4.

The lower 8 bits from bit0(4) to bit7(4) of a gamma value corresponding to a 4th gray are stored in bit0 to bit7 of a byte corresponding to an address which is 3. The higher 2 bits from bit8(4) to bit9(4) are respectively stored in a bit6 to bit7 of a byte corresponding to an address which is 4.

In sum, the gamma values corresponding to the 1st gray, the 2nd gray, the 3rd gray and the 4th gray are stored in the byte corresponding to the addresses from 0 to 4. In other words, four gamma values require 5 bytes of storage space. Correspondingly, 256 gamma values require 320 bytes of storage space. The gamma value look-up table requires 320 bytes of storage space. A color LCD includes three look-up tables for gamma values corresponding to red, green, and blue. For this reason, the three gamma value look-up tables require 960 bytes of storage space.

It is preferred to store the three gamma value look-up tables, along with an On-Screen Display (OSD) application supporting parameters relating to brightness, contrast, borders, and color temperature of the display, in 1024 bytes of memory. Because a typical OSD parameter needs 180 bytes of storage space, 844 bytes of storage space remain in the memory, insufficient in this case to accommodate the three gamma value look-up tables.

What is thus called for is a storage method for gamma value look-up tables which can overcome the above-described deficiencies.

BRIEF DESCRIPTION OF THE DRAWINGS

FIG. 1 is a gamma value look-up table used in the method of the disclosure.

FIG. 2 is a commonly used gamma value look-up table.

DETAILED DESCRIPTION

Reference will now be made to the drawings to describe preferred and exemplary embodiments of the disclosure in detail.

FIG. 1 is a gamma value look-up table used in the method of the disclosure, storing gamma values corresponding to a 33rd gray to a 256th gray. Each gamma value corresponding to the 33rd gray to the 256th gray is stored in a 10 bit form. The lower 8 bits from bit0(33) to bit7(33) of a gamma value corresponding to a 33rd gray are stored in bit0 to bit7 of a byte corresponding to an address which is 0. The higher 2 bits from bit8 (33) to bit9 (33) are respectively stored in bit0 to bit1 of a byte corresponding to an address which is 4.

The lower 8 bits from bit0(34) to bit7(34) of a gamma value corresponding to a 34th gray are stored in bit0 to bit7 of a byte corresponding to an address which is 1. The higher 2 bits from bit8(34) to bit9(34) are respectively stored in bit2 to bit3 of a byte corresponding to an address which is 4.

The lower 8 bits from bit0(35) to bit7(35) of a gamma value corresponding to a 35th gray are stored in bit0 to bit7 of a byte corresponding to an address which is 2. The higher 2 bits from bit8(35) to bit9(35) are respectively stored in bit4 to bit5 of a byte corresponding to an address which is 4.

The lower 8 bits from bit0(36) to bit7(36) of a gamma value corresponding to a 36th gray are stored in bit0 to bit7 of a byte corresponding to an address which is 3. The higher 2 bits from bit8(36) to bit9(36) are respectively stored in bit6 to bit7 of a byte corresponding to an address which is 4.

In sum, the gamma values corresponding to the 33rd gray, the 34th gray, the 35th gray and the 36th gray are stored in the bytes corresponding to the addresses from 0 to 4. By parity of reasoning, the gamma values corresponding to the 33rd gray to the 256th gray require 280 bytes of storage space.

Gamma values corresponding to a 1st gray to a 32nd gray can be expressed as the formula:

$$gamma(i) = gamma(256) \times \left(\frac{i}{256}\right)^{\gamma} + \left(\frac{gamma(33) - gamma(256) \times \left(\frac{32}{256}\right)^{\gamma}}{32}\right) \times i$$

Wherein i denotes a gray, i exceeds or equals 1 and is less than or equal to 32, gamma(i) denotes a gamma value corresponding to an ith gray, gamma(256) denotes a gamma value corresponding to the 256th gray, gamma(33) denotes a gamma value corresponding to the 33rd gray, and γ denotes a parameter exceeding or equaling 1.8 and less than or equal to 2.4. The preferred value of the parameter γ is 2.2.

Because the gamma value look-up table stores only the gamma values corresponding to the 33rd gray to the 256th gray and the gamma values corresponding to the 1st gray to the 32nd gray can be calculated by the formula, the gamma value look-up table requires 280 bytes of storage space. Three gamma value look-up tables require 840 bytes of storage space. For this reason, the three gamma value look-up tables and an OSD parameter can be stored in 1024 bytes of storage space.

In the described exemplary embodiment, in the presence of more than 256 grays, the storage method of the gamma value look-up table is also useful.

It is to be further understood that even though numerous characteristics and advantages of preferred and exemplary embodiments have been set out in the foregoing description, together with details of structures and functions associated with the embodiments, the disclosure is illustrative only, and changes may be made in detail (including in matters of arrangement of parts) within the principles of the disclosure to the full extent indicated by the broad general meaning of the terms in which the appended claims are expressed.

What is claimed is:

1. A method for a gamma value look-up table in a memory of an electronic device, comprising:

storing gamma values corresponding to grays exceeding or equaling a 33rd gray in the gamma value look-up table of the electronic device; and calculating gamma values corresponding to a 1st gray to a 32nd gray by a formula, wherein the gamma values corresponding to the 1st gray to the 32nd gray are expressed as the formula:

$$gamma(i) = gamma(256) \times \left(\frac{i}{256}\right)^{\gamma} + \left(\frac{gamma(33) - gamma(256) \times \left(\frac{32}{256}\right)^{\gamma}}{32}\right) \times i,$$

where, i denotes a gray, i exceeds or equals 1 and is less than or equal to 32, gamma(i) denotes a gamma value corresponding to an ith gray, gamma(256) denotes a gamma value corresponding to the 256th gray, gamma(33) denotes a gamma value corresponding to the 33rd gray, and γ denotes a parameter exceeding or equaling 1.8 and less than or equal to 2.4.

2. The method of claim 1, wherein the number of grays is 256.

3. The method of claim 1, wherein the parameter γ is 2.2.

4. The method of claim 3, wherein each gamma value corresponding to the 33rd gray to the 256th gray is stored in a 10 bit form.

5. The method of claim 4, wherein gamma values corresponding to the 33rd gray, a 34th gray, a 35th gray and a 36th gray are stored in bytes corresponding to addresses from 0 to 4.

6. The method of claim 5, further comprising:

storing the lower 8 bits of a gamma value corresponding to a 33rd gray in bit0 to bit7 of a byte corresponding to an address which is 0;

storing the higher 2 bits of the gamma value corresponding to the 33rd gray in bit0 to bit1 of a byte corresponding to an address which is 4 respectively;

storing the lower 8 bits of a gamma value corresponding to a 34th gray in bit0 to bit7 of a byte corresponding to an address which is 1;

storing the higher 2 bits of the gamma value corresponding to the 34th gray in bit2 to bit3 of a byte corresponding to an address which is 4 respectively;

storing the lower 8 bits of a gamma value corresponding to a 35th gray in bit0 to bit7 of a byte corresponding to an address which is 2;

storing the higher 2 bits of the gamma value corresponding to the 35th gray in bit4 to bit5 of a byte corresponding to an address which is 4 respectively;

storing the lower 8 bits of a gamma value corresponding to a 36th gray in bit0 to bit7 of a byte corresponding to an address which is 3;

storing the higher 2 bits of the gamma value corresponding to the 36th gray in bit6 to bit7 of a byte corresponding to an address which is 4 respectively.

* * * * *